US005838809A

United States Patent [19]

Sato et al.

[11] Patent Number: 5,838,809

[45] Date of Patent: Nov. 17, 1998

[54] SPEAKER

[75] Inventors: Masanobu Sato; Fujio Hayakawa, both of Tokyo; Ikuo Saga; Taizo Nakamura, both of Aichi, all of Japan

[73] Assignees: Mitsubishi Jidosha Kogyo Kabushiki Kaisha; Mitsubishi Denki Kabushiki Kaisha, both of Tokyo, Japan

[21] Appl. No.: 48,262

[22] Filed: Mar. 26, 1998

[30] Foreign Application Priority Data

May 30, 1997 [JP] Japan ..... 9-142774

[51] Int. Cl.[6] ..... H04R 25/00

[52] U.S. Cl. ..... 381/409; 381/400

[58] Field of Search ..... 381/396, 400, 381/401, 409, 406, 410

[56] References Cited

U.S. PATENT DOCUMENTS 3,609,652 9/1971 Sebastian ..... 381/409

5,583,944 12/1996 Norohoshi et al. ..... 381/400

FOREIGN PATENT DOCUMENTS

U 57-94288 11/1955 Japan .

U-7-39194 7/1995 Japan .

*Primary Examiner*—Huyen Le

[57] ABSTRACT

A tinsel cord support member 30 is formed on a gasket 24, two grooves for supporting tinsel cords 26 and conducting them from a tip end portion of the tinsel cord support member 30 up to near terminal lugs 28 are formed at predetermined intervals from each other in the tinsel cord support member, and a hollow portion 30*a* is provided between the two grooves formed in the tinsel cord support member 30.

4 Claims, 9 Drawing Sheets

SPEAKER

BACKGROUND OF THE INVENTION

1. Field of the Invention

The present invention relates to a speaker of a highly waterproof structure wherein a tinsel cord support member is provided so as to overhang in front of a diaphragm and a tinsel cords are guided through the tinsel cord support member.

2. Description of the Prior Art

FIG. 13 is a sectional view showing the construction of a conventional dynamic speaker disclosed, for example, in Japanese Non-examined Utility Model Publication No. 7-39194. In the same figure, numeral 1 denotes a diaphragm, numeral 2 denotes a dust cap serving as a dustproof means for the diaphragm 1, numeral 3 denotes an edge member for supporting the diaphragm 1, numeral 4 denotes a gasket for pressing down and fixing the edge member 3, numeral 5 denotes a lead-out wire of a voice coil 13, numeral 6 denotes a tinsel cord formed of a flexible conductor for conducting an inputted signal to the voice coil 13, numeral 7 denotes an eyelet formed in the surface of the diaphragm 1, numeral 8 denotes a terminal strip for signal input, numeral 9 denotes a tinsel cord support member for supporting the tinsel cords 6 and conducting them up to near the terminal strip 8, numeral 10 denotes a frame for supporting components of the speaker, numeral 11 denotes an annular magnet, numeral 12 denotes a plate for conducting a magnetic flux generated by the magnet 11, numeral 13 denotes a voice coil, numeral 14 denotes a bobbin with the voice coil 13 wound thereon, numeral 15 denotes a damper which supports the bobbin 14, and numeral 16 denotes a pole piece for conducting the magnetic flux generated by the magnet.

In the conventional speaker, a base end portion of the diaphragm 1 is bonded to a front end portion of the bobbin 14, and an outer peripheral edge portion of the diaphragm 1 is bonded to an inner peripheral edge of the edge member 3. The dust cap 2 is bonded to a front central portion of the diaphragm 1. The lead-out wires 5 are drawn out from the voice coil 13 up to the eyelets 7 along the surface of the diaphragm 1 and is connected to one ends of the tinsel cords 6. The opposite ends of the tinsel cords 6 are guided by the tinsel cord support member 9 and are connected to the terminal strip 8. The terminal strip 8 is secured to a flange of the frame 10. The tinsel cord support member 9 extends across the upper surface of the gasket 4 and is attached to the terminal strip 8 so as to overhang in front of the diaphragm 1. The magnet 11 is held grippingly between the plate 12 and the pole piece 16. The plate 12 is secured to the frame 10. The bobbin 14 is supported by the damper 15 and is disposed in a clearance between the pole piece 16 and the plate 12. Further, the damper 15 is mounted to the frame 10.

The conventional speaker, a magnetic circuit is constituted by the magnet 11, the plate 12 and the pole piece 16. By this magnetic circuit, there is formed a magnetic flux distribution in the clearance between the plate 12 and the pole piece 16.

When such a conventional speaker is to be used for a vehicle, the speaker is attached to the inner panel of a door with bolts or the like in such a manner that the terminal strip 8 is positioned on the passenger's compartment side inside the door.

The operation of the conventional speaker will be described below.

Upon signal input in the terminal strip 8 there flows an electric current in the voice coil 13 located within the magnetic flux and an electromotive force is created in accordance with Fleming's left-hand rule. With this electromotive force, the diaphragm 1 vibrates and acoustic waves are generated.

SUMMARY OF THE INVENTION

In the conventional speaker constructed as above, the tinsel cord support member 9 is of a shape not taking into account the rebound of the acoustic waves generated from the speaker. Consequently, there has been such a problem that the sound pressure characteristic of the acoustic waves generated from the speaker is disturbed, thus exerting a bad influence on the output sound pressure frequency characteristic.

Further, there has such a problem that since the tinsel cord support member 9 for supporting the tinsel cords 6 is positioned higher than the upper surface of the gasket 4, the tinsel cords 6 protrude easily from the upper surface of the gasket when the diaphragm 1 vibrates to the front, with the result that the tinsel cords 6 come into contact with a grill or a dustproof net mounted in front of the speaker, giving rise to abnormal sounds.

The present invention has been accomplished for solving the above-mentioned problems and it is an object of the invention to provide a speaker of a construction capable of preventing the disturbance in the sound pressure characteristic of the acoustic waves generated from the speaker.

It is another object of the present invention to provide a speaker capable of preventing contact of tinsel cords with a grill or a dustproof net mounted in front of the speaker and thereby preventing the generation of the abnormal sounds.

According to the present invention, in a first aspect thereof, there is provided a speaker wherein a tinsel cord support member is provided in a gasket, two grooves are formed in the tinsel cord support member at a predetermined spacing from each other to support a tinsel cords and conduct them from a tip end portion of the tinsel cord support member up to near input terminals disposed outside the gasket, and a hollow portion is formed between the two grooves.

According to the speaker in the first aspect of the invention, since it is constructed as above, it is possible to prevent acoustic waves generated by the speaker from being obstructed by the tinsel cord support member, thereby prevent disturbance of the sound pressure characteristic and maintain the output sound pressure frequency characteristic in a good condition.

In a second aspect of the present invention there is provided, in combination with the speaker in the first aspect, a speaker wherein the tip end portion of the tinsel cord support member is positioned lower than the upper surface of the gasket.

According to the speaker in the second aspect of the invention, since it is constructed as above, even when the diaphragm vibrates to the front, it is possible to prevent the generation of abnormal sounds caused by contact of the tinsel cords with a grill or a dustproof net mounted in front of the speaker.

In a third aspect of the present invention there is provided, in combination with the speaker in the first aspect, a speaker wherein a dislodgment preventing portion is formed at the tip end of the tinsel cord support member to prevent the tinsel cords from coming off the grooves formed in the tinsel cord support member when the diaphragm vibrates to the front and the tinsel cords rise.

According to the speaker in the third aspect of the invention, since it is constructed as above, the tinsel cords become difficult to come off the grooves even when the tinsel cords rise with forward vibration of the diaphragm.

In the fourth aspect of the present invention, in combination with the speaker in the first aspect, there is provided a speaker wherein the tinsel cord support member is formed by integral molding with the gasket.

According to the speaker in the fourth aspect of the invention, since it is constructed as above, the number of components used decreases and the manufacturing efficiency is high.

DETAILED DESCRIPTION OF THE PREFERRED EMBODIMENTS

Embodiments of the present invention will be described hereinunder.

First Embodiment

Figure 1:
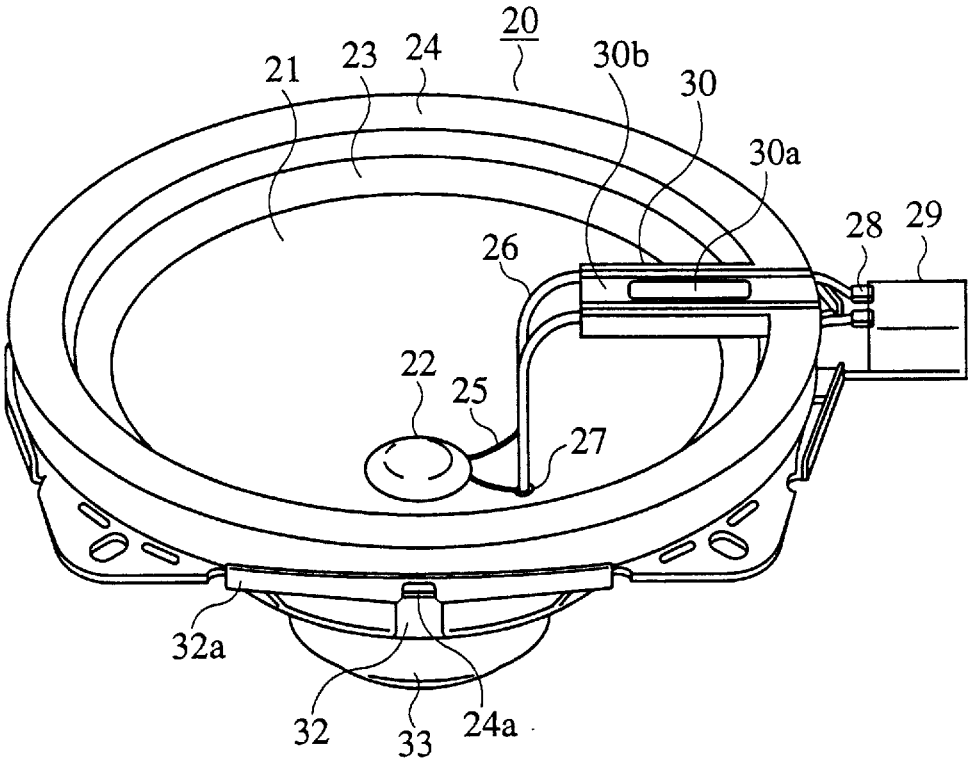
FIG. 1 is a perspective view showing the construction of a speaker according to the first embodiment of the present invention.
Figure 2:
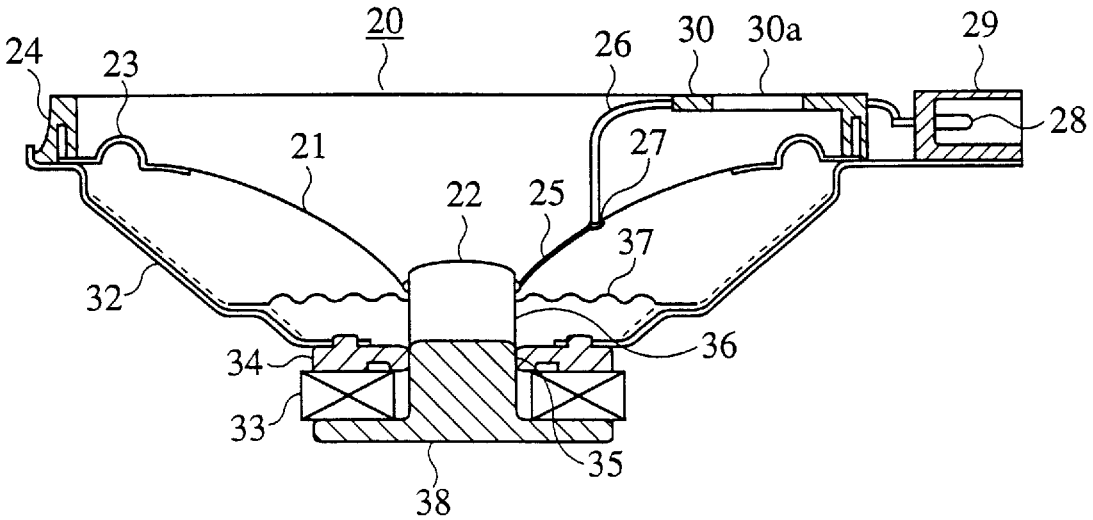
FIG. 2 is a sectional view thereof.
Figure 3:
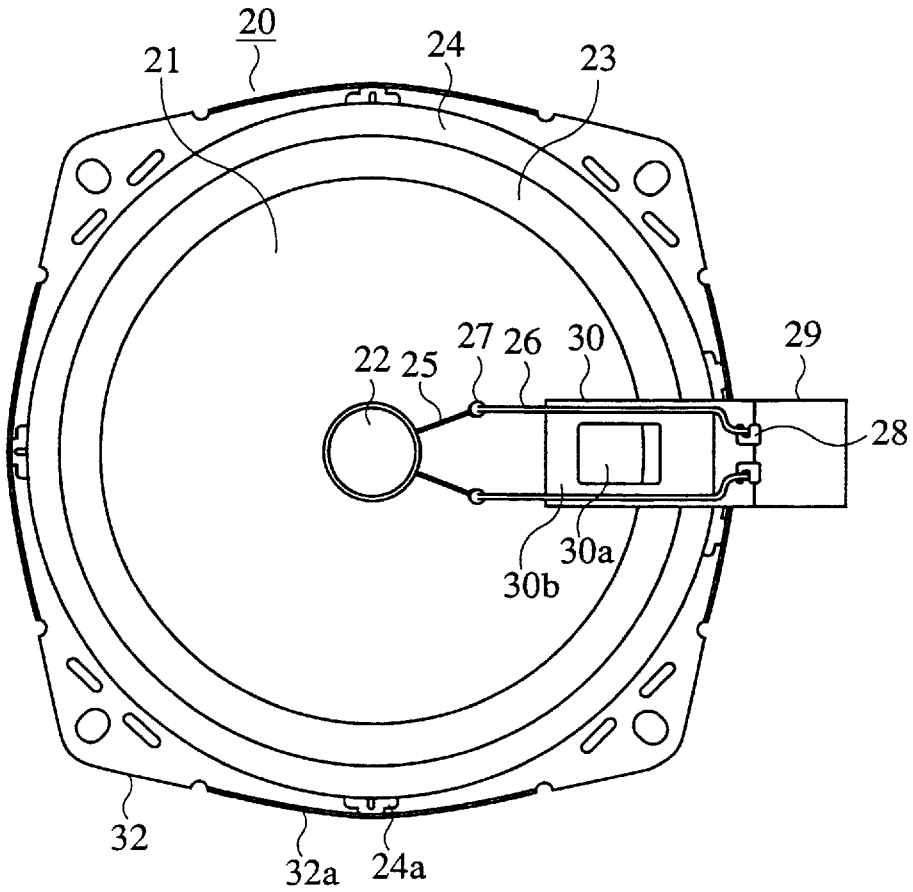
FIG. 3 is a plan view thereof.

FIGS. 1 to 3 are construction diagrams showing a speaker according to the first embodiment of the present invention, of which FIG. 1 is a perspective view, FIG. 2 is a sectional view, and FIG. 3 is a plan view as seen from the front of a diaphragm. In FIGS. 1 to 3, numeral 20 denotes a speaker, numeral 21 denotes a diaphragm, numeral 22 denotes a dust cap serving as a dustproof means for the diaphragm 1, numeral 23 denotes an edge member for supporting the diaphragm 21, numeral 24 denotes a gasket for pressing down and fixing the edge member 23, numeral 24*a* denotes a positioning lug formed on the gasket, numeral 25 denotes a lead-out wire of a voice coil 35, numeral 26 denotes a tinsel cord formed of a flexible conductor to conduct an inputted signal to the voice coil 35, numeral 27 denotes an eyelet formed in the surface of the diaphragm 21, numeral 28 denotes a terminal lug (input terminal) provided for signal input, numeral 29 denotes a terminal housing for surrounding and protecting the terminal lugs 28, numeral 30 denotes a tinsel cord support member for supporting the tinsel cords 26 and conducting them up to near the terminal lugs 28, numeral 30*a* denotes a hollow portion formed in the tinsel cord support member 30, numeral 30*b* denotes a bridge for reinforcing the tinsel cord support member 30, numeral 32 denotes a frame for supporting components of the speaker, numeral 32*a* denotes a raised portion formed by bending an edge of the frame 32, numeral 33 denotes an annular magnet, numeral 34 denotes a plate for conducting a magnetic flux generated by the magnet 33, numeral 35 denotes a voice coil, numeral 36 denotes a bobbin with the voice coil 35 wound thereon, numeral 37 denotes a damper for supporting the bobbin 36, and numeral 38 denotes a pole piece for conducting the magnetic flux generated by the magnet.

Figure 4:
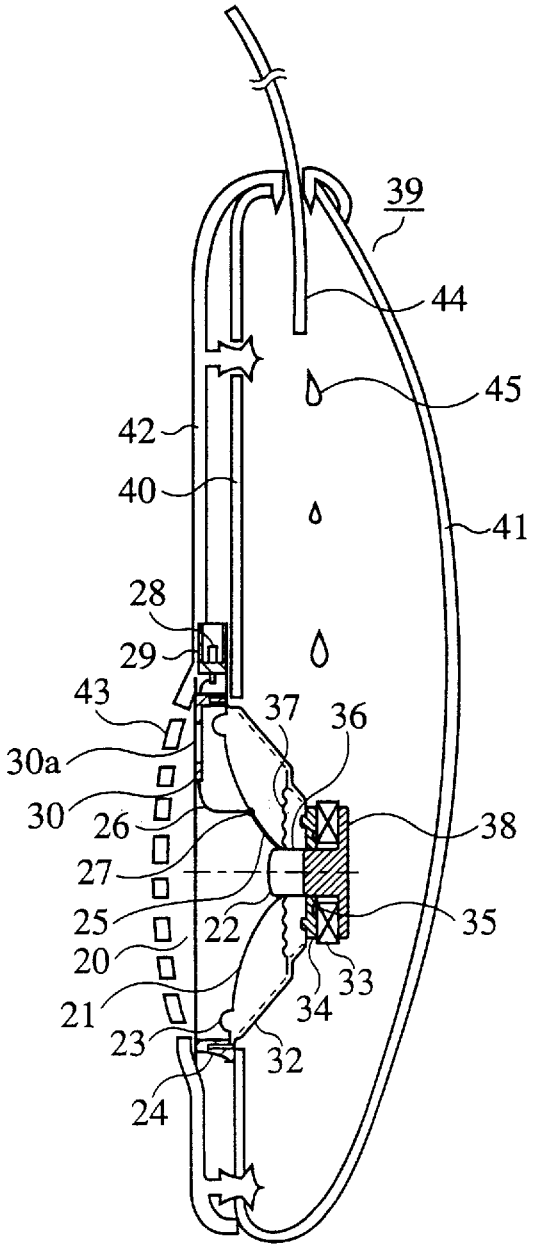
FIG. 4 is a sectional view showing a state of the speaker attached to a door of an automobile.

FIG. 4 is a sectional view showing a state the speaker of the first embodiment attached to a door of an automobile. In the same figure, numeral 39 denotes a door of an automobile, numeral 40 denotes an inner panel of the door 39 which panel is located on the passenger's compartment side of the automobile, numeral 41 denotes an outer panel of the door 39, numeral 42 denotes a door trim of a design panel attached to the inner panel 40, numeral 43 denotes a grill which transmits acoustic waves generated from the speaker, the grill 43 being disposed in a portion of the door trim 42 which portion is positioned in front of the diaphragm 21, numeral 44 denotes a window glass mounted in the door 39, and numeral 45 denotes a water drop, coming down from the window glass 44, which has entered the interior of the door 39. In FIG. 4, the portions identical with or equivalent to those in FIGS. 1 to 3 are indicated by the same reference numerals as in FIGS. 1 to 3 and explanations thereof are here omitted.

In the speaker 20 of the first embodiment, a base end portion of the diaphragm 21 is bonded to a front end portion of the bobbin 36, and an outer peripheral edge portion of the diaphragm 21 is bonded to an inner peripheral edge of the edge member 23. The dust cap 22 is bonded to a front central portion of the diaphragm 21. The lead-out wires 25 are drawn out from the voice coil 35 up to the eyelets 27 along the surface of the diaphragm 21 and are connected to one-side ends of the tinsel cords 26. In the tinsel cord support member 30 are formed two grooves at a spacing of about 20 mm for supporting the tinsel cords 26 and conducting them from a tip end portion of the tinsel cord support member 30 up to near the terminal lugs 28. The opposite ends of the tinsel cords 26 are guided by the tinsel cord support member 30 and are connected to the terminal lugs 28. The terminal lugs 28 are located outside the gasket 24. The tinsel cord support member 30 is provided on the gasket 24 by integral molding with the gasket so as to overhang to the front of the diaphragm 21. The hollow portion 30*a* is located between the two grooves formed in the tinsel cord support member 30. The magnet 33 is sandwiched in between the plate 34 and the pole piece 38. The plate 34 is secured to the frame 32. The bobbin 36 is supported by the damper 37 and is disposed in a clearance between the pole piece 38 and the plate 34. Further, the damper 37 is mounted to the frame 32.

Figure 5:
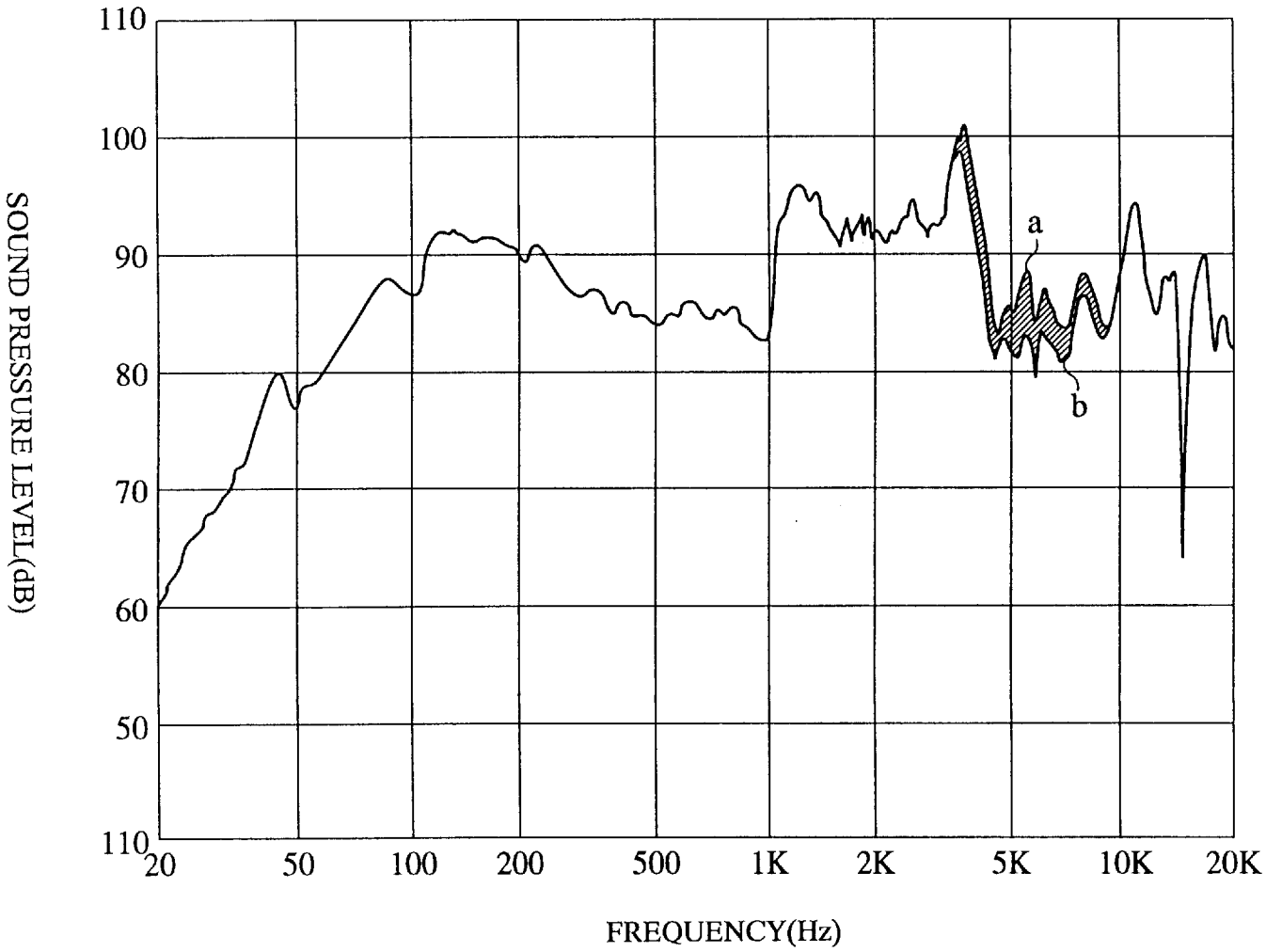
FIG. 5 is a diagram of comparison in sound pressure characteristics between the case where a hollow portion is formed and the case where the hollow portion is not formed.
Figure 6:
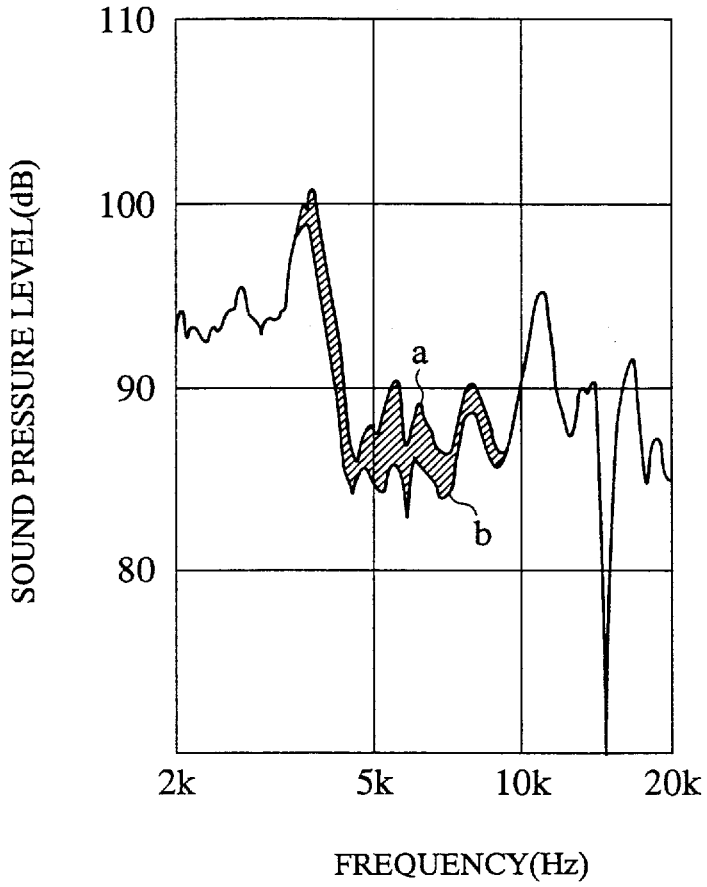
FIG. 6 is an enlarged diagram of a principal portion in FIG. 5.

Thus, in the speaker 20 of the first embodiment, the hollow portion 30*a* is provided between the two grooves formed in the tinsel cord support member 30 to diminish the surface area of the support member 30 on the side opposed to the diaphragm 21 and reduce the weight of the support member 30. As a result, the disturbance in the sound pressure characteristic is prevented which disturbance occurs when acoustic waves generated from the speaker 20 are obstructed by the tinsel cord support member 30. FIGS. 5 and 6 compare between the sound pressure characteristics obtained in the case where the hollow portion 30*a* is formed in the support member 30 and that obtained in the absence of the hollow portion 30*a*. In the same figures, a sound pressure level (dB) is plotted along the axis of ordinate, while frequency (Hz) is plotted along the axis of abscissa. FIG. 6 is an enlarged diagram of a principal portion of FIG. 5. The sound pressure characteristics shown in FIGS. 5 and 6 are of a full range type speaker having a diameter of 16 cm. At the surface of the tinsel cord support member 30 on the side opposed to the diaphragm 21, the size of the hollow portion 30*a* is about 20 mm×15 mm. In FIGS. 5 and 6, the curved line "a" represents the sound pressure characteristic in the presence of the hollow portion 30*a*, while the curved line "b" represents the same characteristic in the absence of the hollow portion 30*a*. As shown in both figures, with the hollow portion 30*a* formed in the tinsel cord support member 30, the sound pressure level is improved in a frequency range of about 4 to 8 kHz. More particularly, the sound pressure level is improved 2 dB, 3 dB, 4 dB, 2.5 dB and 1 dB at the frequencies of 4 kHz, 5 kHz, 6 kHz, 7 kHz and 8 kHz, respectively.

The spacing between the two grooves formed in the tinsel cord support member 30 is set at about 20 mm to prevent tinsel cords 26 from coming into contact with each other when deflected.

The bridge 30*b* for reinforcing the tinsel cord support member 30 is provided between the two grooves formed in the support member 30. Therefore, a bending stress imposed on one groove is dispersed to the other groove, thereby preventing the one groove from being cut.

One end of each tinsel cord 26 is connected to the lead-out wire 25 at the position of the eyelet 27, while the opposite end thereof is connected to the associated terminal lug 28, and each tinsel cord 26 is supported in the associated groove formed in the tinsel cord support member 30 over its portion located from the tip end of the support member 30 up to a position near the terminal lug 28. Each tinsel cord 26 thus supported is fixed by both the eyelet 27 and the tip end portion of the support member 30. The length of the tinsel cords 26 positioned between the eyelets 27 and the tip end of the support member 30 is set so as to become larger than the distance between the eyelets 27 and the tip end of the support member 30 in a most rearwardly vibrated state of the diaphragm 21. Further, an adjustment has been made in such a manner that the tinsel cords 26 describe gentle circular arcs of, say, a radius of 3 to 10 mm at the position from the eyelets 27 to the tip end of the tinsel cord support member 30 and with the diaphragm 21 vibrating neither forward nor backward. By so doing, when the diaphragm 21 vibrates backward, breakings of the tinsel cords 26 caused by the action of tensions thereon are prevented, and when the diaphragm 21 vibrates forward, breakings of the tinsel cords 26 are prevented which are caused by sharp bends of the tinsel cords 26 and the resulting imposition of a bending stress thereon.

Three raised portions 32*a* are formed along the edge of the frame 32 and a square opening of about 5 mm×4 mm is formed nearly centrally of each raised portion 32*a*, while on the outer peripheral portion of the gasket 24 are formed three positioning lugs 24*a* so as to be respectively fitted in the opening formed in each raised portions 32*a*, the positioning lugs 24*a* being each slightly smaller than the opening formed in each raised portion 32*a*. Consequently, when the positioning lugs 24*a* are respectively fitted in the openings of the raised portions 32*a* to assemble the speaker 20, it is possible to align the gasket 24 and the frame 32 with respect to each other, so that the speaker assembling work becomes easier. Besides, the gasket 24 can be brought into close contact with the frame 32 and hence it becomes easier to perform the bonding work for both gasket 24 and frame 32. Even if there are four or more fitting positions between openings formed in the raised portions 32*a* and positioning lugs 24*a* formed on the gasket 24, the same effects as above can be obtained.

Further, The tinsel cord support member 30 is formed by integral molding with the gasket 24. Therefore, the number of components used becomes smaller and the manufacturing efficiency of the speaker 20 becomes higher.

The operation of the speaker according to the first embodiment will be described below.

When signals are inputted to the terminal lugs 28, there flows an electric current in the voice coil 35 placed within a magnetic flux through the tinsel cords 26 and lead-out wires 25, so that an electromotive force is generated in accordance with Fleming's left-hand rule. With this electromotive force the diaphragm 21 vibrates and generates acoustic waves. Of the two terminal lugs 28, one is a positive terminal lug and the other is a negative terminal lug. Usually, when a positive voltage is applied to the positive terminal lug, the diaphragm vibrates forward, while when a negative voltage is applied thereto, the diaphragm 21 vibrates backward. When the diaphragm 21 vibrates forward to decrease the distance between the eyelets 27 and the tip end of the tinsel cord support member 30, the tinsel cords 26 positioned between the eyelets 27 and the support member 30 are deflected so as to reduce the radius of the circular arcs which they draw. On the other hand, when the diaphragm 21 vibrates backward to increase the distance between the eyelets 27 and the tip end of the support member 30, the tinsel cords 26 positioned between the eyelets 27 and the tip end of the support member 30 are deflected so as to increase the radius of the circular arcs which the tinsel cords draw. Thus, with vibration of the diaphragm 21, the tinsel cords 26 positioned between the eyelets 27 and the tip end of the tinsel cord support members 30 are deflected according to the distance between the eyelets 27 and the tip end of the support member 30. In both the case where a positive voltage is applied to the positive terminal lug and the case where a negative voltage is applied to the negative terminal lug, the potential of the negative terminal lug is set at the ground potential.

According to this first embodiment, as described above, since the hollow portion 30*a* is provided between the two grooves formed in the tinsel cord support member 30, it is possible to prevent disturbance of the sound pressure characteristic which disturbance occurs when acoustic waves generated from the speaker 20 are obstructed by the support member 30, and hence it is possible to maintain the output sound pressure frequency characteristic in a satisfactory condition.

Further, since the tinsel cord support member 30 is formed by integral molding with the gasket 24, the number of components used becomes smaller and the manufacturing efficiency of the speaker 20 becomes higher.

Second Embodiment

Figure 7:
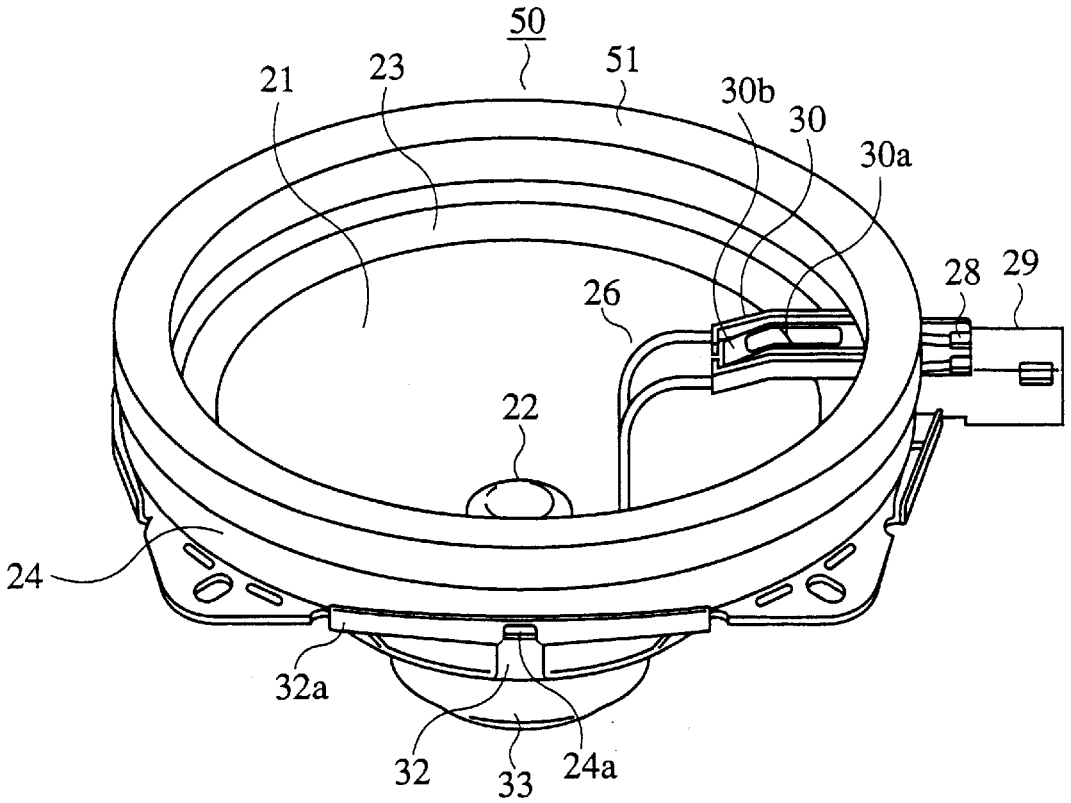
FIG. 7 is a perspective view showing the construction of a speaker according to the second embodiment of the present invention.
Figure 8:
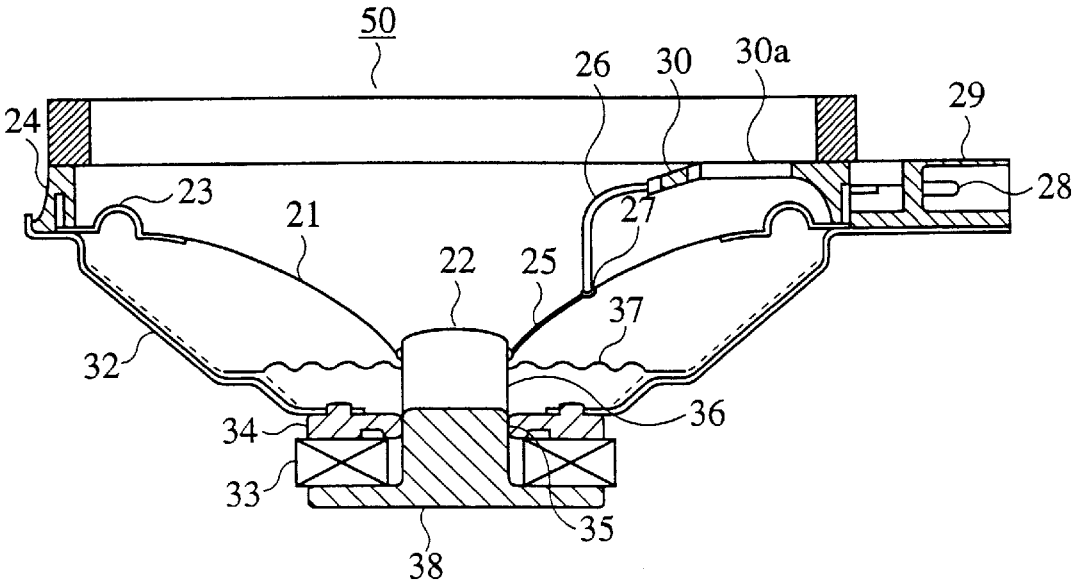
FIG. 8 is a sectional view thereof.
Figure 9:
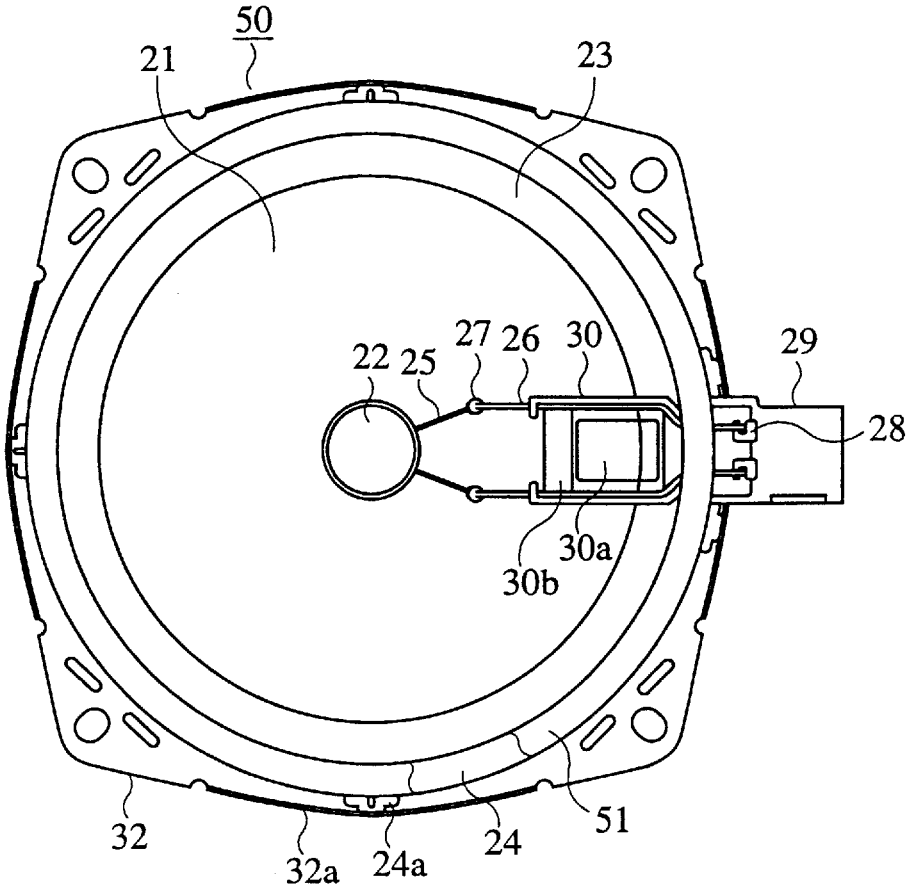
FIG. 9 is a plan view thereof.

FIGS. 7 to 9 illustrate are construction diagrams showing a speaker according to the second embodiment of the present invention, of which FIG. 7 is a perspective view, FIG. 8 is a sectional view and FIG. 9 is a plan view as seen from the front of a diaphragm. In these figures, numeral 50 denotes a speaker and numeral 51 denotes a cushion affixed to the upper surface of a gasket 24 to keep airtight between a grill (not shown) and the speaker 50. In FIGS. 7 to 9, the portions identical with or equivalent to those in FIGS. 1 to 3 are indicated by the same reference numerals as in FIGS. 1 to 3 and explanations thereof are here omitted.

Figure 10:
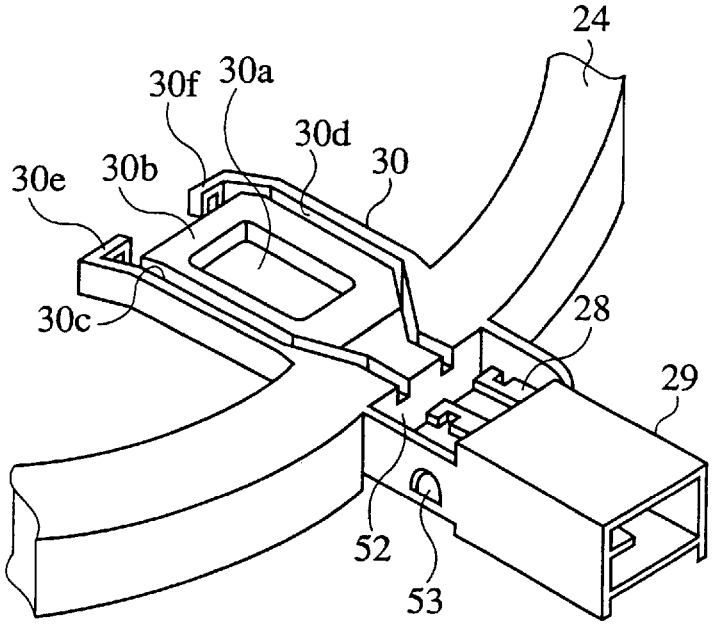
FIG. 10 is a perspective view showing, on a larger scale, a tinsel cord support member, terminal lugs and a terminal housing in the speaker of the second embodiment, with tinsel cords omitted.
Figure 11:
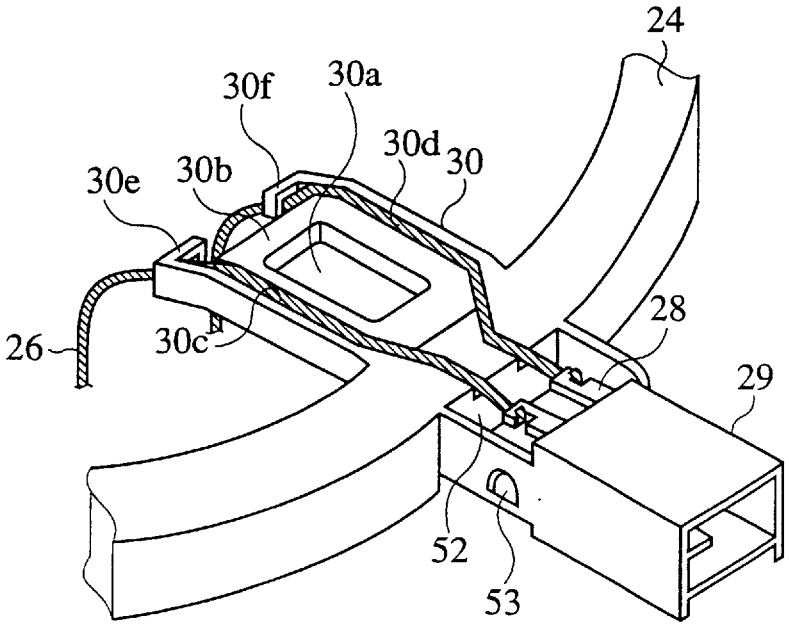
FIG. 11 is a perspective view similar to FIG. 10, with tinsel cords shown.

FIGS. 10 and 11 are perspective views showing, on a larger scale, a tinsel cord support member, terminal lugs and a terminal housing in the speaker of the second embodiment. FIG. 10 shows a state in which tinsel cords are omitted and FIG. 11 shows a state in which tinsel cords are present. In both figures, numerals 30*c* and 30*d* denote grooves formed in a tinsel cord support member 30, and numerals 30*e* and 30*f* denote dislodgment preventing portions formed at the tip end portion of the tinsel cord support member 30 to prevent tinsel cords 26 from coming off the grooves 30*c* and 30*d*. Further, numeral 52 denotes a recess and numeral 53 denotes a side hole. In FIGS. 10 and 11, the portions identical with or equivalent to those in FIGS. 1 to 3 are indicated by the same reference numerals as in FIGS. 1 to 3 and explanations thereof are here omitted.

Figure 12A:
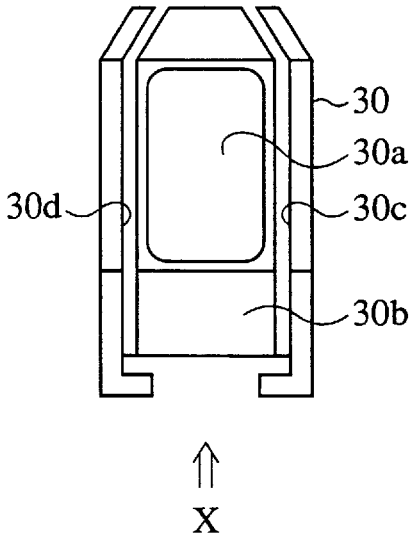
FIGS. 12A and 12B are perspective views showing, on a larger scale, a tip end portion of a tinsel cord support member in the speaker of the second embodiment.
Figure 12B:
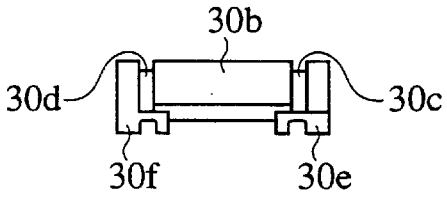
Figure 13:
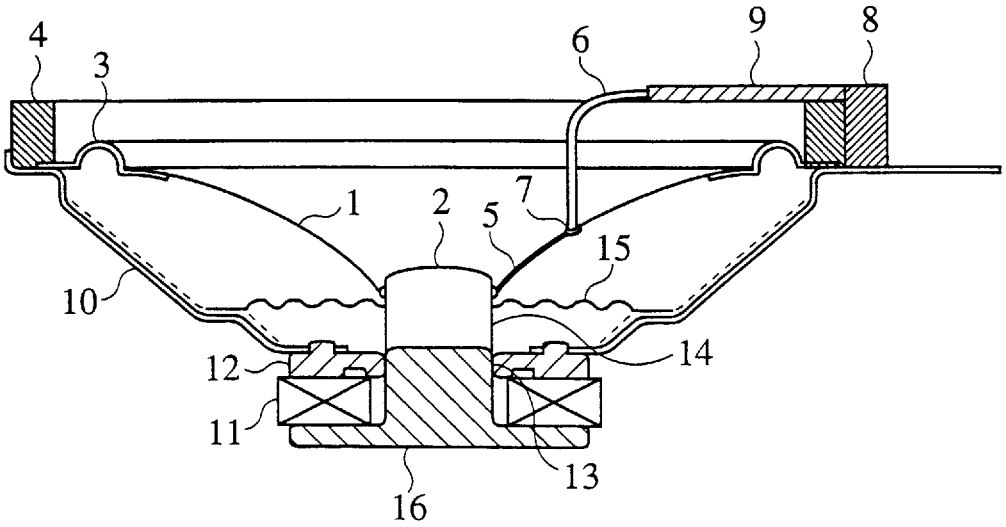
FIG.13(PRIOR ART)
FIG. 13 is a construction diagram showing a conventional speaker.

FIGS. 12A and 12B are construction diagrams showing, on a larger scale, a tip end portion of the tinsel cord support member in the speaker of the second embodiment, with tinsel cords omitted. FIG. 12A is a plan view as seen from the front of a diaphragm and FIG. 12B is a side view as seen in the direction of X in FIG. 12A. In both figures, the portions identical with or equivalent to those in FIGS. 10 and 11 are indicated by the same reference numerals as in FIGS. 10 and 11 and explanations thereof are here omitted.

In the speaker 50 of the second embodiment, a base end portion of a diaphragm 21 is bonded to a front end portion of a bobbin 36, and an outer peripheral edge portion of the diaphragm 21 is bonded to an inner peripheral edge of an edge member 23. A dust cap 22 is bonded to a front central portion of the diaphragm 21. Lead-out wires 25 are drawn out from a voice coil 35 to eyelets 27 along the surface of the diaphragm 21 and are connected to one-side ends of the tinsel cords 26. In the tinsel cord support member 30 are formed two grooves 30*c* and 30*d* at a spacing of about 20 mm from each other to support the tinsel cords 26 and guide them from the tip end portion of the support member 30 up to near terminal lugs 28. The opposite ends of the tinsel cords 26 are guided by the support member 30 and are connected to the terminal lugs 28. The terminal lugs 28 are located outside the gasket 24. The tinsel cord support member 30 is formed on the gasket 24 by integral molding with the gasket 24 and the terminal housing 29 so as to overhang the front of the diaphragm 21, and its tip end portion is located at a position lower than the upper surface of the gasket 24 and coming in no contact with the diaphragm 21 even when the diaphragm 21 vibrates to the front. A hollow portion 30*a* is provided between the two grooves 30*c* and 30*d* formed in the tinsel cord support member 30. A magnet 33 is held grippingly both a plate 34 and a pole piece 38. The plate 34 is secured to a frame 32. The bobbin 36 is supported by a damper 37 and is positioned in a clearance between the pole piece 38 and the plate 34. The damper 37 is mounted to the frame 32.

Thus, in the speaker 50 of the second embodiment, the tip end portion of the tinsel cord support member 30 is positioned lower than the upper surface of the gasket 24. Consequently, even when the diaphragm 21 vibrates to the front, resulting in that the distance between the eyelets 27 and the tip end portion of the tinsel cord support member 30 becomes smaller and the tinsel cords 26 positioned between the eyelet 27 and the tip end of the support member 30 rise while bending, it is difficult for the tinsel cords 26 to project from the upper surface of the gasket 24, whereby it is possible to prevent the generation of abnormal sounds which occurs upon contact of the tinsel cords 26 with a grill or a dustproof net mounted in front of the speaker 50.

The tip end portion of the tinsel cord support member 30 is provided with dislodgment preventing portions 30*e* and 30*f*. Therefore, the motion of the tinsel cords 26 is restricted and it becomes difficult for the tinsel cords 26 to come off the grooves 30*c* and 30*d* even upon forward vibration of the diaphragm 21 and consequent rise of the tinsel cords 26. For example, in FIGS. 12A and 12B, turned square U-shaped members as the dislodgment preventing portions 30*e* and 30*f* are disposed at positions slightly spaced from the tip ends of the grooves 30*c* and 30*d* so that their concaves face down and are located on extension lines from the grooves 30*c* and 30*d*.

The tinsel cord support member 30 is formed by integral molding with the gasket 24 and the terminal housing 29, whereby the number of components used decreases and the manufacturing efficiency of the speaker 50 becomes higher. Besides, the bonding strength between components is enhanced against external forces.

Further, side walls extending from the gasket 24 up to the terminal housing 29 are provided on both right and left sides of the terminal lugs 28 positioned between the gasket 24 and the terminal housing 29, and the terminal lugs 28 are positioned within the recess 52 formed by being surrounded with the gasket 24, terminal housing 29 and side walls. Side holes 53 are formed in lower positions of the side walls. With this arrangement, even when forces are applied transversely to terminal lugs 28 during transport or mounting of the speaker 50, it is possible to prevent the terminal lug from being deformed transversely into contact with the adjacent terminal lug 28. Even in such a case, forces may be exerted from above on terminal lugs 28, but even if the terminal lugs are deformed downward, there is no fear of its contact with the adjacent terminal lug 28. Moreover, solder wastes and tinsel cord wastes resulting from connection of the tinsel cords 26 with the terminal lugs 28 can be discharged from the side holes 53.

According to this second embodiment, since the tip end portion of the tinsel cord support member 30 is positioned lower than the upper surface of the gasket 24, even when the diaphragm 21 vibrates to the front, it is possible to prevent the generation of abnormal sounds which is caused by contact of the tinsel cords 26 with the grill or the dustproof net mounted in front of the speaker 50.

Moreover, since the dislodgment preventing portions 30*e* and 30*f* are provided at the tip end portion of the tinsel cord support member 30, it is difficult for the tinsel cords 26 to come off the grooves 30*c* and 30*d* even upon forward vibration of the diaphragm 21 and consequent rise of the tinsel cords 26.

Further, since the tinsel cord support member 30 is formed by integral molding with the gasket 24, the number of components used decreases and the manufacturing efficiency of the speaker 50 becomes high.

What is claimed is:

1. A speaker of a highly waterproof structure in which a tinsel cord support member is provided so as to overhang to the front of a diaphragm and tinsel cords are guided through said tinsel cord support member, wherein:

said tinsel cord support member is formed on a gasket, two grooves for supporting said tinsel cords and conducting them from a tip end portion of the tinsel cord support member up to near input terminals provided outside said gasket are formed at a predetermined spacing from each other in the tinsel cord support member, and a hollow portion is provided between said grooves formed in the tinsel cord support member.

2. A speaker according to claim 1, wherein the tip end portion of said tinsel cord support member is positioned lower than the upper surface of said gasket.

3. A speaker according to claim 1, wherein said tinsel cord support member has at the tip end portion thereof a dislodgment preventing portion for preventing said tinsel cords from coming off said grooves formed in the tinsel cord support member when said diaphragm vibrates to the front and the tinsel cords rise.

4. A speaker according to claim 1, wherein said tinsel cord support member is formed by integral molding with said gasket.

* * * * *